United States Patent [19]

Rose et al.

[11] 4,288,077

[45] Sep. 8, 1981

[54] HORSE RACE LOTTERY GAME

[76] Inventors: William A. Rose, 1225 Eastland Dr., Lexington, Ky. 40505; Scott D. Rose, 4510 N. Sherman Dr., Indianapolis, Ind. 46226

[21] Appl. No.: 138,523

[22] Filed: Apr. 8, 1980

[51] Int. Cl.[3] ..... A63F 3/00

[52] U.S. Cl. ..... 273/246; 273/138 R

[58] Field of Search ..... 273/246, 269, 277, 259, 273/139, 138 R

[56] References Cited

U.S. PATENT DOCUMENTS

| | | | |
|---|---|---|---|
| 1,697,023 | 1/1929 | Rottenburg | 273/246 |
| 1,900,005 | 3/1933 | Yasuda | 273/138 R |
| 2,062,168 | 11/1936 | Entwistle | 273/246 |

FOREIGN PATENT DOCUMENTS

| | | | |
|---|---|---|---|
| 1230901 | 9/1960 | France | 273/138 R |
| 1528618 | 5/1968 | France | 273/246 |

OTHER PUBLICATIONS

John Scarne, *Scarne's Complete Guide to Gambling,* Simon and Schuster, Inc., N.Y. c 1961, pp. 146–151.

*Primary Examiner*—Richard C. Pinkham

*Assistant Examiner*—Scott L. Brown

*Attorney, Agent, or Firm*—Albert L. Jeffers; John F. Hoffman

[57] ABSTRACT

This invention relates to a horse racing lottery game. The apparatus for the game comprises a racetrack having a plurality of starting positions and a finish line, a plurality of game pieces supported on the track and being movable therearound, there being less game pieces than players playing the game, and a plurality of groups of tickets corresponding to the game pieces such that each group has a plurality of tickets each having indicia corresponding to only one of the game pieces and indicia enabling each ticket to be distinguished from other tickets of the same group. Each player selects tickets of his choice and places the selected tickets of each group in a separate container pertaining to the respective game piece. The tickets are then shuffled, and one ticket is drawn at random from each container, thereby indicating which of the players is assigned to each of the horses running in the race. The starting positions of the horses are determined, the starting positions preferably influencing the odds for a given horse. The horses are then caused to move out of their starting positions and around the racetrack until all have crossed the finish line.

18 Claims, 8 Drawing Figures

HORSE RACE LOTTERY GAME

BACKGROUND OF THE INVENTION

The present invention relates to a horse race game, and in particular to a horse race lottery game which can be played by a large number of people.

There are a number of prior art horse race games wherein miniature representations of horses are incrementally moved around a miniature track based on the throw of dice, actuation of a spinner, the drawing of cards having numbers thereon, and the like. In such games, however, the total number of players is equal to or less than the number of game pieces which are moved, so that all players participate in the race.

Another group of prior art games includes games of chance wherein one or several players are selected from a larger group of players participating in the game. An example of this type of game includes standard lotteries wherein a large number of people purchase lottery tickets, but only a small number of tickets are selected and the participants are rewarded based on the order of selecting the tickets. Generally, the tickets are placed in a common container and drawn at random, so the participants are not capable of influencing the odds that their tickets will be drawn.

A drawback to the prior art horse race games is that there is little in the way of generating interest aside from the mechanics of rolling dice or spinning a spinner to move the miniature horses around the track. In the case of a lottery, because the draw is completely random, the only means for increasing the odds of winning is to purchase a larger number of tickets. Once the ticket or tickets have been purchased, however, the participants have nothing to do except await the outcome of the draw.

SUMMARY OF THE INVENTION

The game according to the present invention overcomes the disadvantages of the above-discussed prior art games by combining the features of a lottery and horse race game. Specifically, the actual race itself is participated in by only a portion of the total number of players, and the selection of players participating in the race is accomplished by a random draw. The game can be organized such that the players will know in advance the post positions of the horses, which preferably affects the odds of any given horse finishing ahead of the remaining horses. With this knowledge, the players can select or purchase tickets which will increase their odds of either being selected for participation in the race, or selecting a horse which will win the race or finish in the top three positions. Thus, the game combines the element of chance with the excitement of a horse race and permits the participants to exercise discretion in influencing the odds for ultimately winning the race. This combination of elements is such that the interest of the participants is maintained throughout the game from initial selection of the cards to the eventual running of the race.

Specifically, the present invention contemplates a horse race lottery game for a plurality of the players comprising in combination a racetrack having a plurality of laterally spaced starting positions and a finish line, a plurality of game pieces adapted to be supported on the racetrack and movable therearound, there being less game pieces than number of players, and a plurality of groups of tickets selectable by the players and corresponding respectively to the game pieces, wherein each of the groups comprises a plurality of tickets having indicia thereon corresponding to only one of the game pieces and indicia thereon enabling each ticket to be distinguished from the other tickets of the same group. A plurality of containers equal in number to the number of the groups of tickets receive the respective groups of tickets and enable the tickets of each group to be shuffled. One ticket is then drawn at random from each container thereby determining which players will be assigned to their respective game pieces during the subsequent running of the race. Means are provided for determining the starting position of each of the game pieces, and there are means for enabling the game pieces to move out of their respective starting positions and around the racetrack until all of the game pieces have crossed the finish line, thereby determining the finishing placings of the game pieces assigned to the respective players selected by the container draw.

The present invention also relates to a method for playing a horse race lottery game comprising providing a racetrack having a plurality of starting positions and a finish line, providing a plurality of game pieces wherein there are less game pieces than players playing the game, and providing a plurality of groups of tickets corresponding respectively to the game pieces wherein each group comprises a plurality of tickets having indicia corresponding to only one of the game pieces and indicia enabling each ticket to be distinguished from the other tickets of the same group. Each player selects one or more tickets of his choice and places the selected tickets of each group in a separate container such that the selected tickets are stored in containers pertaining to the respective game pieces. The tickets are then shuffled in the respective containers and one ticket is drawn at random from each container thereby assigning a player to each of the game pieces. The starting positions of each of the game pieces is determined, either before or after the selection of tickets by the players, and the game pieces are moved to their respective starting positions. The game pieces are then caused to move out of their starting positions and around the racetrack until all of the game pieces cross the finish line thereby determining the finishing placings of the game pieces assigned to the winner of the container draw.

In one form of the invention, the starting positions of the game pieces, which are preferably in the form of horses, are determined prior to the selection of tickets by the players. If the game is organized such that the starting positions affect the odds of a particular horse winning the race, then players desiring to increase their odds of selecting a horse which will win the race, will purchase or select cards for the most favorable starting position. If, on the other hand, the player is interested in bettering his odds of being selected by the container draw for participation in the race, a different strategy will normally be employed. In this case, he will attempt to place himself in a smaller group by selecting a horse with a less favorable starting position. Although the horse selected by him will have lower odds of winning the race, he is more likely to be selected for participation in the race.

The various strategies and skill involved in the selection of tickets pertaining to a particular horse maintains the interest of the participants, as opposed to the above-discussed prior art games which are much simpler and do not permit any discretionary judgment on the part of the participants. Moreover, the game according to the invention is quite versatile in that it can be played by groups of varying sizes, such as at private parties or banquets, entire companies, and can even be played on a state or national level coinciding, if desired, to horse races in which there is national interest, such as the Kentucky Derby. Furthermore, the game could incorporate a national horse race as a portion thereof with the purchase price of the cards pertaining to the horses varying depending on the handicapping of the horses running in the race.

DETAILED DESCRIPTION

Figure 1:
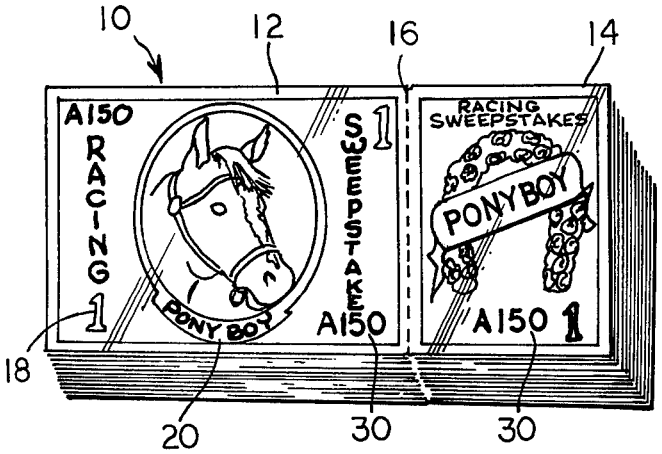
FIG. 1 illustrates in perspective a stack of numbered cards corresponding to the game pieces wherein one half of the card is held by the player and the other half is deposited in the appropriate container illustrated in FIG. 3.

Referring now to the drawings, and in particular FIG. 1, the game according to the present invention comprises a plurality of cards or tickets 10 each of which comprises a main portion 12 and a stub 14, which is connected to main portion 12 by a line of perforations 16. Only one of the tickets 10 is illustrated completely, and it will be seen to include a number 18 indicating the number of the horse, the horse's name 20, which in this case is "Pony Boy". The tickets 10 may also include handicap information for each horse.

The stack of tickets 10 comprises ten groups of tickets, each including, for example, one hundred and fifty such tickets, wherein all the tickets of a particular group correspond to a single horse. Thus, the stack 10 would include one hundred and fifty tickets for horse No. 1 (Pony Boy), one hundred and fifty tickets for horse No. 2, which would have a different name, one hundred and fifty tickets for horse No. 3, and so on, thereby making a total of fifteen hundred tickets. In order to distinguish each ticket of a group from the other tickets of the same group, the tickets are numbered seqentially at 30 for each group beginning with number 1 and ending with 150, for example. It will be appreciated that the stubs 14 carry the same numerical indicia 30 and 18 and name indicia 20 as the main portions 12, for reasons which will be explained hereinafter. In the case where the game is employed as a state or national lottery, the individual tickets 10 will be specially coded by computer to avoid forgery or tampering.

Figure 2:
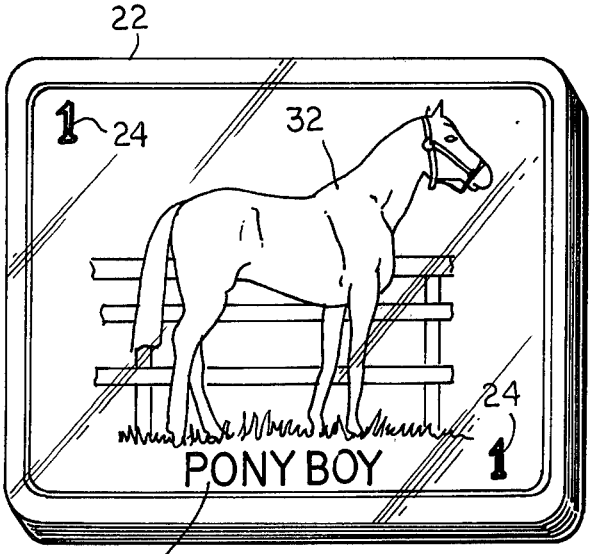
FIG. 2 is a perspective view of a stack of the placards given to the winners of the container draw.

FIG. 2 illustrates a stack of placards 22, which are preferably larger than tickets 10 and made of a much more durable material, such as wood, metal or plastic. Each of the placards 10 includes the same number 24 of the horse and the same name 26 of the horse as did the corresponding group of tickets 10. Unlike tickets 10, however, the numerical numbering 30 is not required. Placards may also include a picture of the horse 32 together with a biographical sketch of the horse including its previous race record (not shown).

Although only the top placard 22 of the stack is illustrated fully, each of the other placards 22 includes the same information, which corresponds to the respective groups of tickets 10 illustrated in FIG. 1. The purpose of placards 22 is to identify the participants in the horse race once the container draw has been completed.

Figure 3:
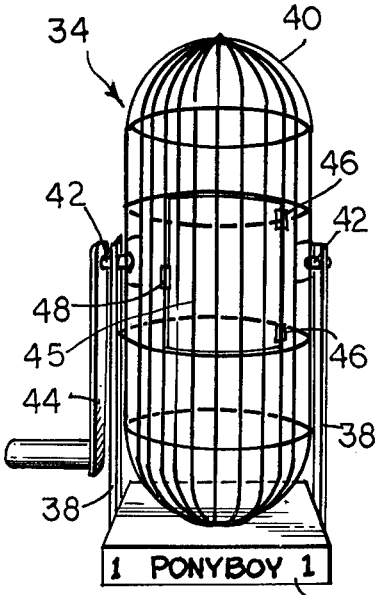
FIG. 3 is a perspective view of one of the containers utilized for the draw.

The game is initiated by opening the selection or purchase of tickets 10 to the players of the game. In the simplest version of the game, the post positions of the horses is unknown at this time, and the participants select the tickets 10 at random. The stub portion 14 for each ticket 10 is separated from the main portion 12 by tearing along the perforated line 16, and the player places the small stub portion 14 in one of ten draw cages 34, one of which is shown in FIG. 3. The main portion 12 of the ticket 10 is retained by the player to enable matching of the drawn stub 14 with the player selecting or purchasing that ticket. As an alternative to the use of double tickets 10 as shown in FIG. 1, a single ticket having spaces for writing of the purchaser's name, address and telephone number may be used.

A separate drawing cage 34 is provided for each of the horses running in the race, and all of the selected or purchased stubs 14 for a particular horse are placed in the appropriate one of the cages 34. Thus, when the selection of the tickets 10 by the players has been completed, all of the stubs 14 will be grouped according to their original groupings in the respective cages 34.

Referring to FIG. 3, it will be seen that the cage 34 comprises a wood or metal base 36 having upstanding brackets 38 connected thereto, and an appropriately shaped wire cage portion 40 connected to brackets 38 by pivots 42. There is sufficient clearance between the ends of cage portion 40 and base 36 so that cage portion 40 can be rotated about a horizontal axis. A handle 44 is connected to one of the pivots 42 for the purpose of rotating cage portion 40 about its horizontal axis thereby shuffling the cards contained therein. A wire mesh door 45 is connected to cage portion 40 by means of hinges 46, and includes a latch 48 to enable the door 45 to be held in a closed position during rotation.

When all of the tickets 10 have been purchased and the respective stubs 14 placed within the appropriate cages 34, each of the cages 34 is rotated so as to shuffle the stubs 14 therein. Then, a single stub 14 is withdrawn from each of the ten cages 34, and these stubs 14 are matched with the main portions 12 held by the persons purchasing or selecting the tickets 10. These persons are the winners of the cage draw, which means that they are assigned to the respective horses running in the race. For example, the stub 14 drawn from the cage 34 pertaining to horse No. 1 will be matched with the other half 12 of the ticket 10, and that person given the placard 22 pertaining to horse No. 1. Placard 22 for horse No. 1 identifies the person holding it as having been a winner of the cage draw and entitled to control the movements of horse No. 1 in the race. Alternatively, in the case where the game is played in conjunction with an actual horse race, the person holding placard 22 is entitled to reap certain stated benefits resulting from the final standing of horse No. 1 in the race.

In the simpler version of the game, the next step is to determine the post or starting positions of the horses. This is done by placing ten balls 50 made of any appropriate material such as plastic, glass, wood, or the like, into an opaque bottle 52. Each of the balls 50 has a flat side 54 with a numeral 56 thereon, which indicates the starting or post position of the horse. Bottle 52 comprises a hollow, bulbous portion 50 and a relatively narrow neck 60, which has a diameter only slightly larger than the diameter of balls 50.

All of the balls 50 are placed into bottle 52 and then shaken out one at a time through the narrow neck portion 60. Any appropriate procedure can be utilized to determine the post positions of the horses as long as the procedure is stated in advance. For example, the horses could be drawn in numerical sequence, so that the first ball 50 shaken out of bottle 58 corresponds to horse No. 1, the second ball to horse No. 2, and so on. The number on the ball shaken out of bottle 58 will indicate the post position of the horse. Alternatively the post positions can be drawn in sequence with the numbers on balls 50 identifying the horse for that position.

Figure 7:
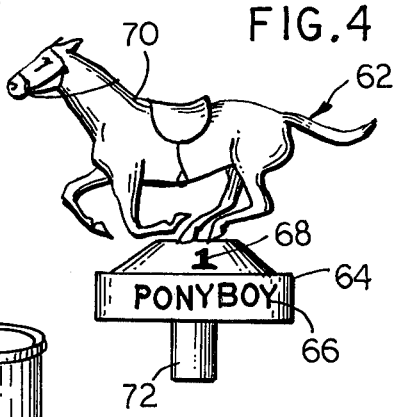
FIG. 7 is a side elevational view of one of the game pieces movable around the racetrack of FIG. 8.
Figure 5:
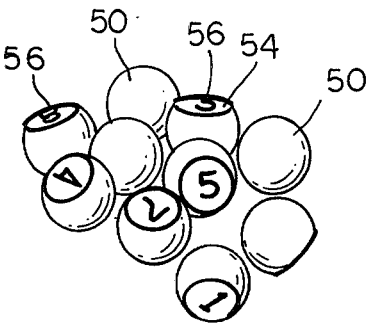
FIG. 5 is a perspective view of the numbered starting position balls.
Figure 6:
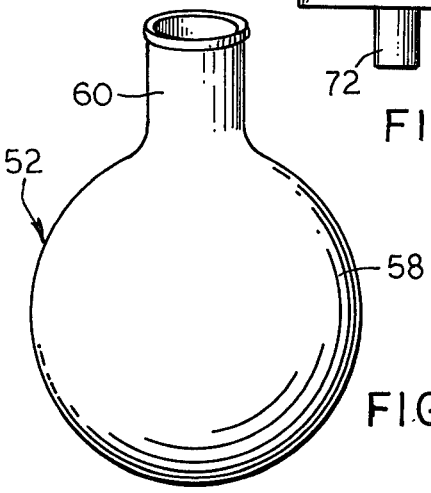
FIG. 6 is a perspective view of a bottle for containing the balls of FIG. 5.

FIG. 7 illustrates one of the game pieces 62 utilized in conjunction with the miniaturized version of the game according to the present invention. It comprises a base 64 on which the name 66 of the horse appears together with the horse's number 68. A three dimensional representation of a horse 70 is connected to base 64. There are ten such game pieces 62, which corresponds to the respective horses running in the race. If desired, each of the horses may have a different appearance with the appearance of the horse shown on tickets 10, placards 22 and games pieces 62 being consistent. Each game piece 62 includes a peg portion 72 which is insertable into peg openings 74 on the miniaturized racetrack 76 illustrated in FIG. 8.

Figure 8:
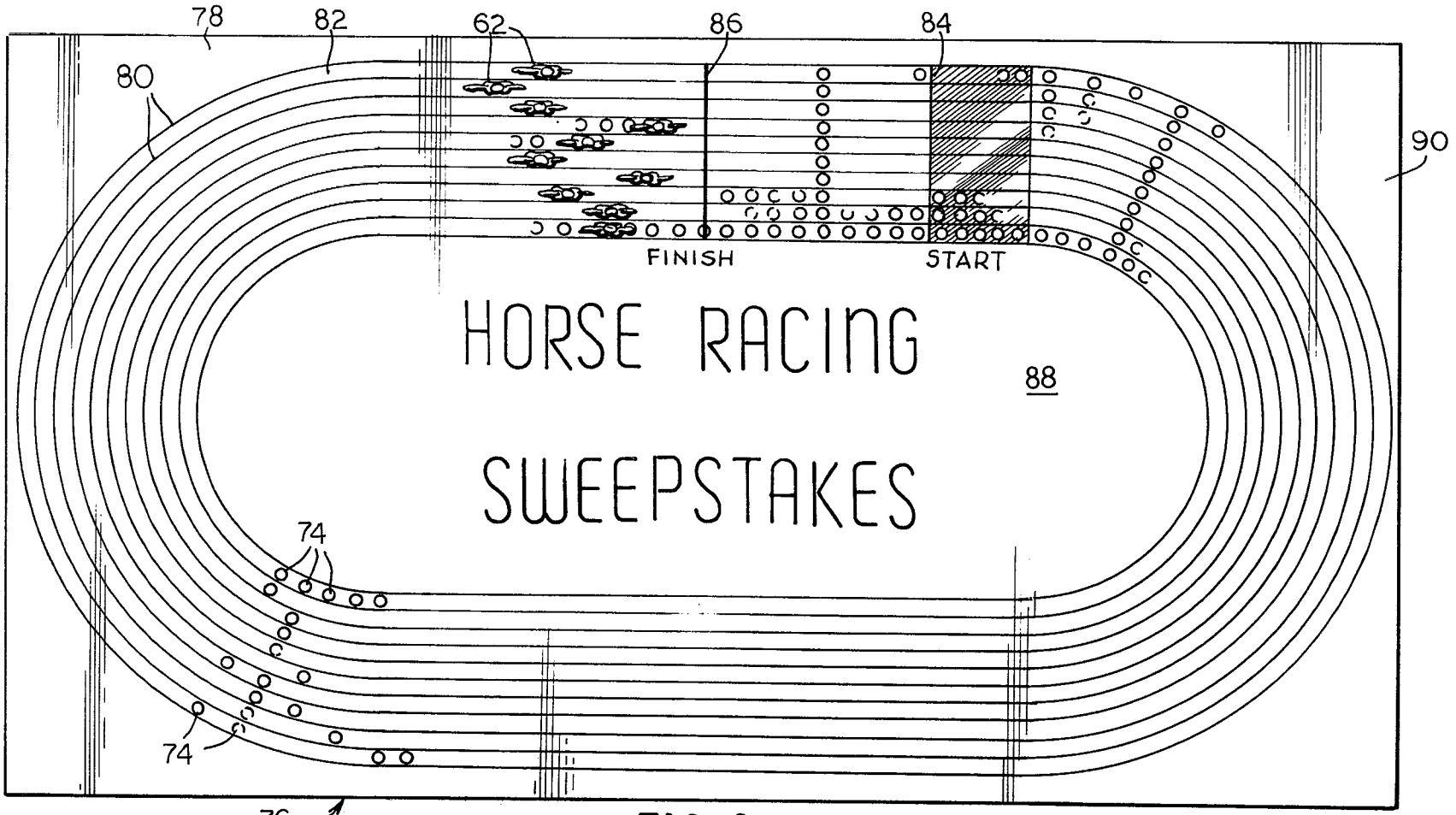
FIG. 8 is a plan view of a miniaturized racetrack board for running of the race.

Referring now to FIG. 8, the racetrack 76 comprises a generally planar board number 78 having a plurality of oval lines 80 defining ten lanes 82. Within each of lanes 82 are a plurality of peg openings 74 dimensioned to receive pegs 72. There are preferably an equal number of peg openings 74 in each of lanes 82 so that all of the horses must pass the same number of discrete increments in moving around the track from the start line 84, past finish line 86 and around again to finish line 86. Alternatively, the tracks 82 could be provided with different numbers of peg openings 74 so that certain tracks would be weighted in favor of winning. If desired, certain horses, such as those closer to the pole position could be handicapped by starting them a certain number of openings 74 behind start line 84.

In order to provide greater authenticity, the infield 88 and surrounding areas 90 of track 76 could be decorated in accordance with the layout of an actual track, such as Churchill Downs.

Figure 4:
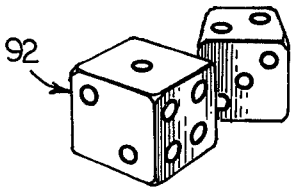
FIG. 4 is a perspective view of a pair of dice for use in determining the increments of movement the game pieces make on the racetrack.

Once the starting positions of the horses has been determined by sequentially drawing balls 50 out of container 58, the three dimensional game pieces 62 are positioned on track 76 in their proper lanes behind starting line 84. The players then roll, in turn, the dice 92 (FIG. 4) and move their respective game pieces 62 a number of peg openings 74 corresponding to the numbers shown by the dice 92. This process continues unit all of the game pieces 62 have been moved completely around track 72 and past finish line 86.

In order to weight the pole position, which is that position nearest the infield 88, in favor of winning and to decrease the advantage of the positions in a direction radially outward, the person holding the game piece 62 in the pole position may be given the first roll, and the person holding the game piece in the position furthest out from the infield 88 may be given the last roll. Since the first horse to cross the finish line will win the race, this increases slightly the odds of the pole position horse.

The race is preferably run until all of the game pieces 62 have crossed the finish line 86 and either monetary awards or an award of points given to the players depending on the final standings, with the highest award given to the first finisher, the next highest award to the second finisher, and so on. Alternatively, awards may be given to only the first three finishers.

In order to increase the strategy in selecting the tickets 10, the post positions of the horses may be preselected by shaking out the balls 50 before tickets 10 are selected. In the case of an actual race, the post positions of the horses would be determined by the racetrack authorities and, therefore, not be under the control of the players of the game.

With the knowledge of the post positions of the horses, the players may utilize a variety of strategies to increase their chances of participating in the race and winning the race itself. Fifty players throw the dice 92 in succession beginning with the innermost horse, then this player will have an advantage in crossing the finish line first. It is likely that most of the players will purchase or select tickets 10 for the pole position or positions near the pole, thereby decreasing the odds of winning the cage draw for these horses. For positions removed from the pole, however, less players are likely to purchase or select the tickets so that players with these horses have increased odds of being selected in the cage draw for participation in the race.

If the game is played in conjunction with an actual horse race, the participants will benefit from knowledge of the horse's post positions and past records so as to increase their odds of participating in and finishing early in the race. Other variations of the game are possible.

Although the game has been illustrated in connection with specific apparatus, various alternatives are contemplated. For example, the track 76 may be made of metal and the bases 76 of game pieces 62 may include a magnet to ensure that the positions of the game pieces 62 are not accidentally disrupted. In this case, the peg opening 74 would be replaced by lateral lines or spaces indicating increments of movement. Track 76 may be laid flat or hung on a wall in a vertical position if means are provided for enabling the game pieces 62 to remain in place in this position. This latter alternative would be useful at a carnival or large banquet where a large number of people would be viewing the running of the race.

While this invention has been described as having a preferred design, it will be understood that it is capable of further modification. This application is, therefore, intended to cover any variations, uses, or adaptations of the invention following the general principles thereof and including such departures from the present disclosure as come within known or customary practice in the art to which this invention pertains and fall within the limits of the appended claims.

What is claimed is:

1. A horse race lottery game for a plurality of players comprising in combination:

a racetrack having a plurality of laterally spaced starting positions and a finish line, a plurality of game pieces adapted to be supported on the racetrack and movable therearound, there being less game pieces than number of players, a plurality of groups of tickets selectable by the players and corresponding respectively to said game pieces wherein each said group comprises a plurality of tickets having first indicia thereon corresponding to only one of the game pieces, and have second indicia means thereon to enable each ticket to be distinguished from the other tickets of the same group, a plurality of container means equal in number to the number of said groups of tickets for receiving the respective groups of tickets and enabling the tickets of each group to be shuffled and enabling one ticket of each group to be drawn at random from each container means thereby determining which of the players is assigned to each game piece during a subsequently run race of the game pieces, means for determining the starting position of each of said game pieces, and means for enabling the game pieces to move out of their starting positions and around the racetrack until all of the game pieces cross the finish line thereby determining the finishing placings of the game pieces assigned to the respective players selected by the container draw.

2. The game of claim 1 wherein: each of said tickets comprises a main portion and a stub portion separated by a perforated area of the ticket such that the stub portion can be separated from the main portion, one of the portions is placed in the respective container, and the other portion is retained by the player selecting the ticket.

3. The game of claim 2 wherein the stub and main portions of each ticket have matching indicia thereon.

4. The game of claim 1 including a placard corresponding to each of said game pieces, said placards being given to the players selected by the container draw for identification during the race of the game pieces.

5. The game of claim 1 wherein said means for determining the starting positions comprises a random selection apparatus.

6. The game of claim 5 wherein said random selection apparatus comprises a starting position container and a plurality of elements contained therein, each of said elements having indicia thereon corresponding uniquely to a starting position, and said starting position container includes means for permitting one of said elements to be withdrawn at a time.

7. The game of claim 5 wherein said random selection apparatus comprises a starting position container and a plurality of elements contained therein, said game pieces are numbered and said elements are correspondingly numbered, and said starting position container is a vessel from which only one element can be withdrawn at a time.

8. The game of claim 1 wherein said game pieces are horses.

9. The game of claim 8 wherein said racetrack is oval and comprises a plurality of lanes each having a plurality of holes therein, and said game pieces include pegs engagable in the racetrack holes.

10. The game of claim 1 including a chance selection device operated in turn by the players selected by the container draw for determining the movement of the game pieces around the racetrack.

11. The game of claim 10 wherein said chance selection device comprises a pair of dice.

12. A method for playing a horse race lottery game comprising:

providing a racetrack having a plurality of starting positions and a finish line, providing a plurality of game pieces, there being less game pieces than players playing the game, providing a plurality of groups of tickets corresponding respectively to the game pieces wherein each group comprises a plurality of tickets having indicia corresponding to only one of the game pieces and having indicia enabling each ticket to be distinguished from the other tickets of the same group, each player selecting one or more tickets of his choice and placing the selected tickets of each group in a separate container such that the selected tickets are stored in containers pertaining to the respective game pieces, shuffling the tickets in their respective containers, drawing at random a single ticket from each container thereby assigning a player to each of the game pieces, determining the starting position of each of the game pieces and moving the game pieces to the respective starting positions on the racetrack, and causing the game pieces to move out of their starting positions and around the racetrack until all of the game pieces have crossed the finish line thereby determining the finishing placings of the game pieces assigned to the winners of the container draw.

13. The method of claim 12 wherein each of the tickets comprises two separable parts and including the step of separating one part of the ticket from the other and placing only one part in the appropriate container.

14. The game of claim 12 wherein the starting positions of the game pieces are determined prior to the selecting of the tickets by the players and wherein the starting positions of the game pieces determines, in part, the odds favoring one game piece crossing the finish line before the other game piece.

15. The method of claim 14 wherein the game pieces are moved around the track as determined by each of the players operating, in turn, a chance selection device indicating the increment of movement of the respective game piece for that turn, and wherein the order of the turns of the players depends on the starting positions of the game pieces.

16. The method of claim 12 wherein the starting positions of the game pieces are determined by chance and after the selecting of the tickets by the players.

17. The method of claim 12 wherein the game pieces are moved around the racetrack by the players throwing dice in turn and the game pieces are moved in accordance with the value of the dice showing after each throw.

18. The method of claim 12 wherein the game pieces are horses.

* * * * *